United States Patent [19]

Samuelson

[11] Patent Number: 4,591,407

[45] Date of Patent: May 27, 1986

[54] TAPE APPLICATOR

[75] Inventor: Bruce E. Samuelson, West Lakeland Township, Washington County, Minn.

[73] Assignee: Minnesota Mining and Manufacturing Company, Saint Paul, Minn.

[21] Appl. No.: 736,251

[22] Filed: May 22, 1985

[51] Int. Cl.[4] ..... B32B 35/00

[52] U.S. Cl. ..... 156/527; 156/577; 156/579

[58] Field of Search ..... 156/523, 527, 574, 576, 156/577, 579

[56] References Cited

U.S. PATENT DOCUMENTS

| | | | |
|---|---|---|---|
| 2,527,588 | 10/1950 | Sorenson | 156/527 |
| 2,722,329 | 11/1955 | Vogt | 156/523 |
| 3,586,587 | 6/1971 | Boyce | 156/577 |
| 3,895,059 | 7/1975 | Link | 156/527 |
| 4,238,272 | 12/1980 | Schleicher | 156/527 |

*Primary Examiner*—Michael Wityshyn
*Attorney, Agent, or Firm*—Donald M. Sell; James A. Smith; William L. Huebsch

[57] ABSTRACT

A tape applicator adapted to be hand held and used to apply a length of pressure sensitive adhesive coated tape to a substrate and to cut the applied length from a supply of the tape in the dispenser. An anvil spaced from a hub that supports a roll of tape may be manually rubbed along the backing of tape being applied by moving the applicator to firmly press it against the substrate, and a cutting edge on the side of the anvil opposite the hub may be used to sever the applied tape by pivoting the dispenser. A retainer will be engaged by the adhesive coating on the tape upon cutting of the tape to retain the cut end of the tape in position adjacent the anvil so that it can be manually pressed against and adhered to a new substrate, and the adhesive coating on the tape will be peeled away from the retainer when that cut end is adhered to a new substrate and the dispenser is initially moved to apply the new length of tape. A resiliently flexible support member fixed at one end relative to the hub and anvil will support the applicator along a horizontal substrate with the anvil spaced away from the substrate, and will be resiliently deflected by pressing the housing toward the substrate to bring the anvil into contact with tape being applied to that substrate.

9 Claims, 6 Drawing Figures

TAPE APPLICATOR

TECHNICAL FIELD

The present invention relates to hand held applicators that can be manually used to apply pressure sensitive adhesive tape to a substrate.

BACKGROUND ART

The art is replete with devices adapted for manual use to apply tape to a substrate. Heretofore, however, such devices have been more difficult to use than would otherwise be desired.

SUMMARY OF THE INVENTION

The present invention provides a tape applicator adapted to be hand held that can be used to apply a length of pressure sensitive adhesive coated tape to a substrate and to cut the applied length of tape from a supply of the tape in the dispenser without requiring a significant amount of manual manipulation other than moving the applicator over the substrate to which the tape is to be applied.

According to the present invention there is provided an applicator comprising a housing including wall means defining a hub adapted to support a roll of pressure sensitive adhesive coated tape for rotation about an axis, and an anvil spaced from the hub that has a pressure surface generally parallel to the axis of the hub and adapted to be manually rubbed along the backing of tape from the roll to firmly adhere the tape against the substrate while the dispenser is moved along the substrate, with the tape extending through a predetermined path area in the housing between the roll and the anvil during such rubbing. The housing also has a cutting edge projecting generally parallel to the axis on the side of the anvil opposite the hub in a position affording spacing of the edge from tape being pressed against a substrate by the anvil but affording manual pivoting of the housing around the anvil to engage the edge with such applied tape to sever it from tape in the dispenser; and a retainer between the hub and the anvil on the side of the predetermined path area opposite the anvil, which retainer has a retaining surface spaced from the predetermined path area and positioned generally parallel to the axis of the hub so as to be engaged by the pressure sensitive adhesive coating on the tape upon cutting of the tape by the cutting edge and to retain the cut end of the tape in a position adjacent the anvil so that it can be pressed against and adhered to a new substrate by manual manipulation of the housing. That retaining surface is positioned so that the pressure sensitive adhesive coating on the tape will be peeled away from the retaining surface when that cut end is adhered to a new substrate and the dispenser is moved to apply tape to it. The wall means of the housing also defines a resiliently flexible elongate support member having a proximal end fixed relative to the hub and anvil with the support member on the side of the retainer opposite the predetermined path area, and a generally planar support surface on the support member disposed generally parallel to the axis of the hub, with a distal end of the support member projecting generally toward and being spaced from the anvil so that with the support surface along a horizontal substrate in the normal position of the support member, the anvil is spaced away from the substrate, and the support member may be resiliently deflected by pressing the housing toward the substrate to bring the anvil into contact with tape being applied to that substrate.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 2:
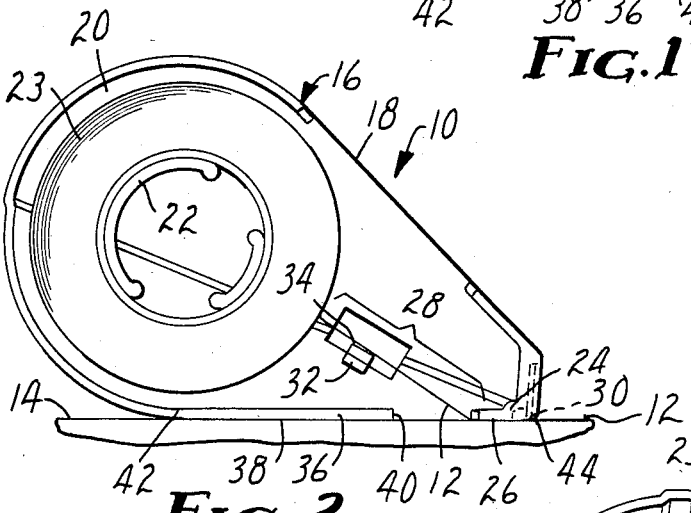
FIG. 2 is a side view of the tape applicator of FIG. 1 being used to apply tape to a substrate.
Figure 3:
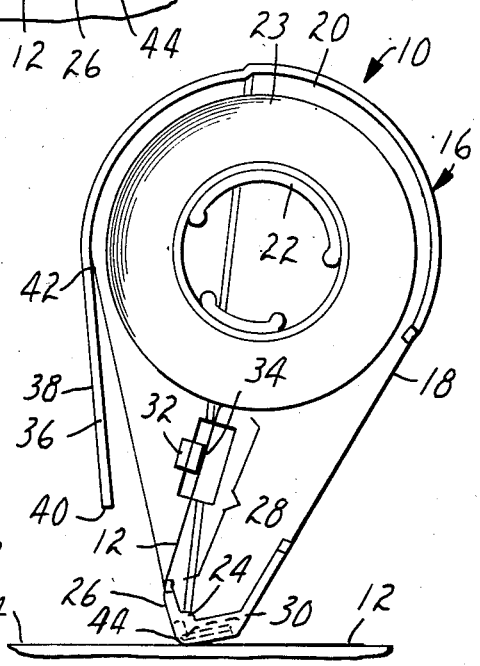
FIG. 3 is a side view of the tape applicator of FIG. 1 being used to cut tape that has been applied to a substrate.
Figure 5:
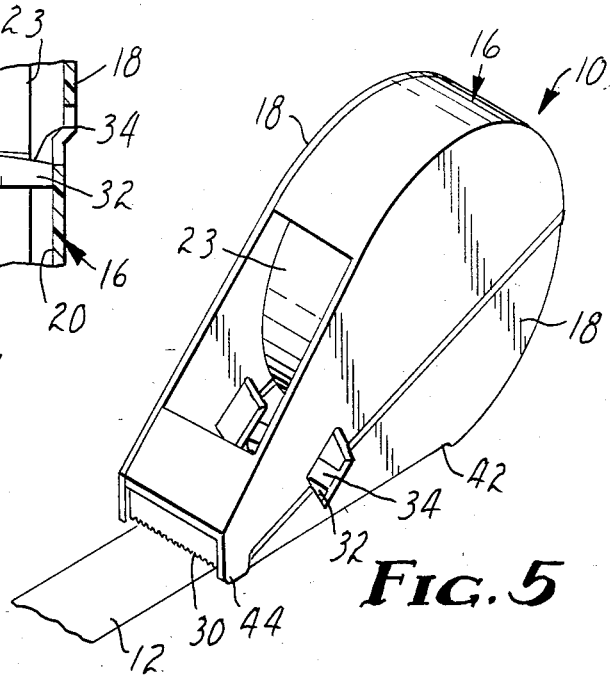
FIGS. 5 and 6 are perspective views of the tape applicator of FIG. 1 being used to apply tape and cut applied tape, respectively.
Figure 6:
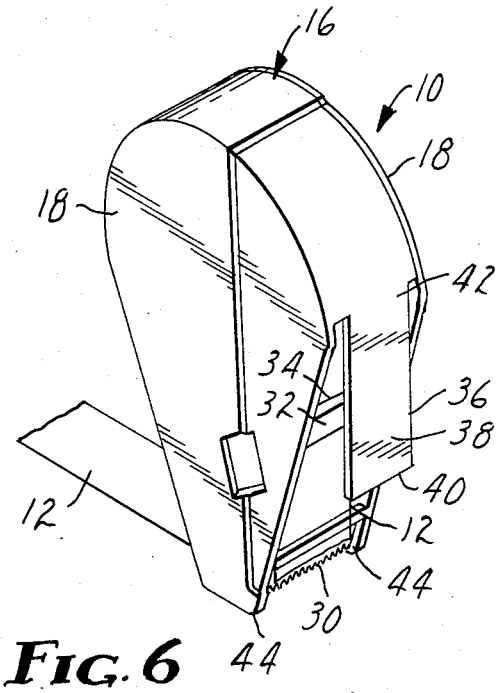

Referring now to the drawing there is shown a tape applicator according to the present invention, generally designated by the reference numeral 10, which tape applicator 10 is adapted to be hand held and used to apply a length of pressure sensitive adhesive coated tape 12 to a substrate 14 (FIGS. 2 and 5) and to then cut the applied length from a supply of the tape 12 in the dispenser 10 (FIGS. 3 and 6).

Figure 1:
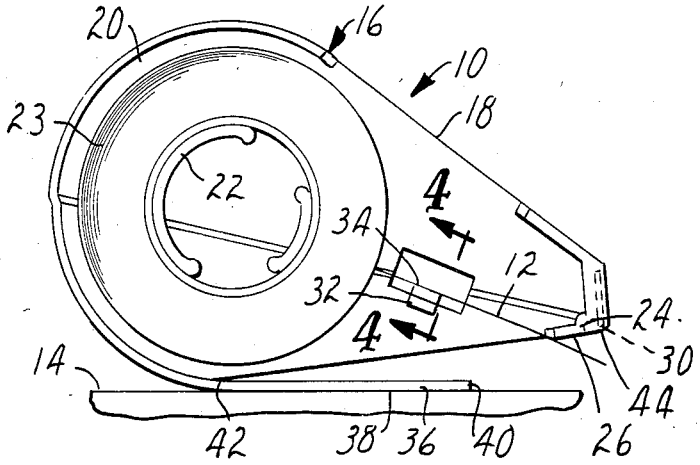
FIG. 1 is a side view of a tape applicator according to the present invention.
Figure 4:
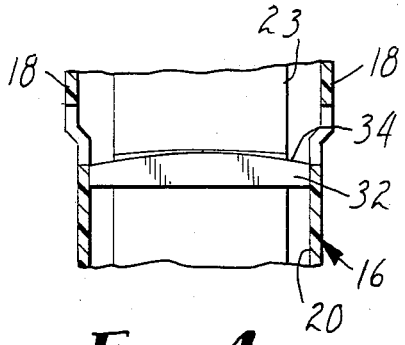
FIG. 4 is an enlarged sectional view taken approximately along line 4—4 of FIG. 1.

The tape applicator 10 comprises a housing 16 including a generally teardrop shaped side wall 18 having a planar inner surface 20, and arcuate walls projecting generally centrally from the inner surface 20 of the large diameter portion of the side wall 18 that provide a hub 22 adapted to support a roll 23 of the pressure sensitive adhesive coated tape 12 for rotation about an axis normal to the inner surface 20. The housing 16 also includes an anvil 24 projecting from the inner surface 20 of the side wall 18 at a position spaced from the hub 22 and having a flat pressure surface 26 extending generally normal to the inner surface 20, which pressure surface 26 is generally parallel to the axis of the hub 22 and is adapted to be manually rubbed along the backing of tape 12 from the roll 23 to adhere an end portion of the tape 12 against the substrate 14 and to firmly press the tape 12 against the substrate 14 while the dispenser 10 is being moved or pulled along the substrate 14 (FIG. 2). While this is happening, the tape 12 extends through a predetermined path area 28 relative to the housing 16 between the roll 23 and the anvil 24 determined by the point at which the tape peels away from the roll 23 (which changes as the diameter of the roll 23 decreases) and the location of the anvil 24. The housing 16 also has a cutting edge 30 (which cutting edge 30 may be provided by teeth formed in the housing wall or by a metal blade attached thereto) projecting generally normal to the inner surface 20 and parallel to the axis of the hub 22 on the side of the anvil 24 opposite the hub 22 in a position affording spacing of the edge 30 from the tape 12 being pressed against the substrate 14 by the anvil 24 but affording manual pivoting of the housing 16 around the anvil 24 (FIGS. 3 and 6) to engage the edge 30 with such applied tape 12 to sever it from the tape 12 in the dispenser 10. A retainer 32 projects from the inner surface 20 of the side wall 18 between the hub 22 and the anvil 24 on the side of the predetermined path area 28 opposite the anvil 24. The retainer 32 has a retaining surface 34 generally parallel to the axis of the hub 22, spaced from the predetermined path area 28 and positioned to be engaged by the pressure sensitive adhesive coating on the tape 12 upon cutting of the tape 12 by the cutting edge 30 to retain the cut end of the tape 12 in position adjacent the anvil 24 so that it can be pressed against and adhered to a new substrate by manual manipulation of the housing 16 (FIGS. 1 and 4). The retaining surface 34 is positioned so that the pressure sensitive adhesive coating on the tape 12 will be peeled away from the retaining surface 34 when that cut end is adhered to a new substrate and the applicator 10 begins movement along that new substrate to apply the tape 12. Also included in the housing 16 is a resiliently flexible elongate rectangular support member 36 having a generally planar support surface 38, a distal end 40, and a proximal end 42 fixed to the side wall 18 with the support member 36 on the side of the retainer 32 opposite the predetermined path area 28. The support surface 38 is disposed generally normal to the inner surface 20 of the side wall 18 and parallel to the axis of the hub 22, with its distal end 40 projecting generally toward and being spaced from the anvil 24 so that, with the support surface 38 along a horizontal substrate 14 in the normal position of the support member 36 (FIG. 1), the anvil 24 and the tape end positioned adjacent the anvil 24 are spaced away from the substrate 14. The support member 36 may be resiliently deflected by pressing the housing 16 toward the substrate 14 (FIG. 2), however, to bring the pressure surface 26 of the anvil 24 in contact with an end of the tape 12 to apply it to that substrate, and to subsequently rub the anvil 24 along the tape 12 as it is applied along that substrate.

Preferably, as illustrated, the housing 16 of the applicator 10 further includes a ramp member 44 on each end of the cutting edge 30, which ramp members 44 project above the cutting edge 30 and serve as cams against the substrate to raise the cutting edge 30 and the portion of the tape 12 being cut by the cutting edge 30 away from the substrate to facilitate cutting the tape 12 when the housing 16 is pivoted to its cutting position (FIGS. 3 and 6).

Also, preferably the retaining surface 34 of the retainer 32 is generally cylindrically convex about an axis disposed at about a right angle to the axis of the hub 22 (FIG. 4). This shape of the retaining surface 34 both limits the amount of contact between the retaining surface 34 and pressure sensitive adhesive coating on the tape 12 which allows the tape 12 to be peeled away more easily when a length of the tape 12 is applied to a substrate, and causes the length of tape 12 projecting past the retainer to have an arcuate cross section which increases its beam strength and helps hold the cut end of the tape 12 more closely adjacent the anvil 24 to facilitae applying the next length of tape 12 to a substrate.

To apply a length of the tape 12 to a substrate 14 using the applicator 10, a user simply manually presses the anvil 24 toward the substrate 14 at about the position he wishes the end of the tape to be. This causes the support member 36 to bend, allowing the pressure surface 26 of the anvil 24 to press the end of the tape 12 against the substrate, which end was initially held adjacent the anvil 24 by adhesive engagement with the retaining surface 34 of the retainer 32. The user then begins to pull the applicator 10 along the surface while applying pressure against the tape backing through the anvil 24 (FIGS. 2 and 5). As the applicator 10 begins to move over the tape 12 being applied, the tape 12 will be peeled away from the retaining surface 34 and will then extend through the path area 28 spaced from the retainer 32. When a desired length of the tape 12 has been applied, a user simply pivots the applicator 10 about 90 degrees about the anvil 24 which brings the cutting edge 30 into cutting engagement with the tape 12 while contact between the ramp members 44 and the substrate cam the edge 30 and the tape 12 around the edge 30 away from the substrate where it may be easily cut (FIGS. 3 and 6). Upon being cut, the residual curl from being rolled in the piece of tape 12 projecting from the roll 23 within the applicator 10 will cause that piece of tape to bend out of the path area 28 and engage and adhere to the retaining surface 34 with the end portion of the tape 12 positioned adjacent the anvil 24 ready for the application of another length of tape 12 (FIGS. 1 and 4). If the user then sets the applicator 10 on a horizontal surface, it will rest on the support surface 38 of the support member 36 which is no longer deflected and thus supports the anvil 24 and tape end in a position spaced from that surface.

The present invention has now been described with reference to a preferred embodiment thereof. It will be evident to those skilled in the art that many changes could be made in the structural details of applicator 10 without departing from the spirit of the invention. For example, the walls of the housing 16 could be changed as by providing a sidewall the shape of the sidewall 18 on both sides of the housing, or by providing one or two sidewalls of substantially different shape from that shown while retaining the function of supporting the active parts of the applicator. Thus, the scope of the claims should not be limited by the structure desribed with reference to the drawing, but only by the structures described by the language of the claims and their equivalents.

I claim:

1. A tape applicator adapted to be hand held and used to apply a length of pressure sensitive adhesive coated tape to a substrate and to cut the applied length from a supply of the tape in the dispenser, said applicator comprising a housing including wall means for defining:

a hub adapted to support a roll of pressure sensitive adhesive coated tape for rotation about an axis;

an anvil spaced from said hub that has a pressure surface generally parallel to the axis of the hub adapted to be manually rubbed along the backing of tape from the roll to firmly press the tape against the substrate while the dispenser is being moved along the substrate, with the tape extending through a predetermined path area in the housing between the roll and the anvil during such rubbing;

a cutting edge projecting generally parallel to the axis on the side of the anvil opposite the hub in a position affording spacing of the edge from tape being pressed against a substrate by the anvil but affording manual pivoting of the housing around the anvil to engage the edge with such applied tape to sever it from tape remaining in the dispenser;

a retainer between said hub and said anvil on the side of said predetermined path area opposite said anvil, said retainer having a retaining surface spaced from said predetermined path area and positioned generally parallel to the axis of the hub so as to be engaged by the pressure sensitive adhesive coating on the tape upon cutting of the tape by said cutting edge to retain the cut end of the tape in position adjacent the anvil so that it can be pressed against and adhered to a new substrate by manual manipulation of the housing, and being positioned so that the pressure sensitive adhesive coating on the tape will be peeled away from said retaining surface when that cut end is adhered to a new substrate and the dispenser is initially moved along the new substrate with the pressure surface pressing the tape into engagement with the new substrate; and a resiliently flexible elongate support member having a generally planar support surface, a distal end, a proximal end fixed relative to the hub and anvil with said support member on the side of said retainer opposite said predetermined path area, said support surface disposed generally parallel to the axis of the hub, and said distal end projecting generally toward and being spaced from said anvil so that with the support surface along a horizontal substrate in the normal position of said support member said anvil is spaced away from the substrate, and said support member may be resiliently deflected by pressing the housing toward the substrate to bring the anvil into contact with tape being applied to that substrate.

2. A tape applicator according to claim 1 wherein said housing further includes a ramp member on each end of said cutting edge and projecting above said cutting edge to raise the portion of the tape being cut by said edge above the substrate while the tape is being severed by the cutting edge.

3. A tape applicator according to claim 1 wherein the retaining surface of said retainer is generally cylindrically convex about an axis disposed at about a right angle to the axis of said hub.

4. A tape applicator adapted to be hand held and used to apply a length of pressure sensitive adhesive coated tape to a substrate and to cut the applied length from a supply of the tape in the dispenser, said applicator comprising a housing including:

a side wall having an inner surface;

a hub projecting from the inner surface of said side wall adapted to support a roll of pressure sensitive adhesive coated tape for rotation about an axis normal to said inner surface;

an anvil projecting from the inner surface of said side wall at a position spaced from said hub and having a pressure surface generally normal to said inner surface adapted to be manually rubbed along the backing of tape from the roll to firmly press the tape against the substrate while the dispenser is being moved along the substrate, with the tape extending through a predetermined path area between the roll and the anvil during such rubbing;

a cutting edge projecting generally normal to the inner surface on the side of the anvil opposite the hub in a position affording spacing of the edge from tape being pressed against a substrate by the anvil but affording manual pivoting of the housing around the anvil to engage the edge with such applied tape to sever it from tape remaining in the dispenser;

a retainer projecting from the side wall between said hub and said anvil on the side of said predetermined path area opposite said anvil, said retainer having a retaining surface spaced from said predetermined path area and positioned to be engaged by the pressure sensitive adhesive coating on the tape upon cutting of the tape by said cutting edge to retain the cut end of the tape in position adjacent the anvil so that it can be pressed against and adhered to a new substrate by manual manipulation of the housing, and being positioned so that the pressure sensitive adhesive coating on the tape will be peeled away from said retaining surface when that cut end is adhered to a new substrate and the dispenser is initially moved along the new substrate with the pressure surface pressing the tape into engagement with the new substrate; and a resiliently flexible elongate support member having a generally planar support surface, a distal end, a proximal end fixed to said side wall with said support member on the side of said retainer opposite said predetermined path area, said support surface disposed generally normal to said side wall, said distal end projecting generally toward and being spaced from said anvil so that with the support surface along a horizontal substrate in the normal position of said support member said anvil is spaced away from the substrate, and said support member may be resiliently deflected by pressing the housing toward the substrate to bring the anvil into contact with tape being applied to that substrate.

5. A tape applicator according to claim 4 wherein said housing further includes a ramp member on each end of said cutting edge and projecting above said cutting edge to raise the portion of the tape being cut by said edge above the substrate while the tape is being severed by the cutting edge.

6. A tape applicator according to claim 4 wherein the retaining surface of said retainer is generally cylindrically convex about an axis disposed at about a right angle to the axis of said hub.

7. A tape applicator adapted to be hand held and used to apply a length of pressure sensitive adhesive coated tape to a substrate and to cut the applied length from a supply of the tape in the dispenser, said applicator comprising:

a roll of pressure sensitive adhesive coated tape; and a housing including wall means for defining:

a hub adapted to support said roll of pressure sensitive adhesive coated tape for rotation about an axis;

an anvil spaced from said hub that has a pressure surface generally parallel to the axis of the hub adapted to be manually rubbed along the backing of tape from said roll to firmly press the tape against the substrate while the dispenser is being moved along the substrate, with the tape extending through a predetermined path area in the housing between the roll and the anvil during such rubbing;

a cutting edge projecting generally parallel to the axis on the side of the anvil opposite the hub in a position affording spacing of the edge from tape being pressed against a substrate by the anvil but affording manual pivoting of the housing around the anvil to engage the edge with such applied tape to sever it from tape remaining in the dispenser;

a retainer between said hub and said anvil on the side of said predetermined path area opposite said anvil, said retainer having a retaining surface spaced from said predetermined path area and positioned generally parallel to the axis of the hub so as to be engaged by the pressure sensitive adhesive coating on the tape upon cutting of the tape by said cutting edge to retain the cut end of the tape in position adjacent the anvil so that it can be pressed against and adhered to a new substrate by manual manipulation of the housing, and being positioned so that the pressure sensitive adhesive coating on the tape will be peeled away from said retaining surface when that cut end is adhered to a new substrate and the dispenser is initially moved along the new substrate with the pressure surface pressing the tape into engagement with the new substrate; and a resiliently flexible elongate support member having a generally planar support surface, a distal end, a proximal end fixed relative to the hub and anvil with said support member on the side of said retainer opposite said predetermined path area, said support surface disposed generally parallel to the axis of the hub, and said distal end projecting generally toward and being spaced from said anvil so that with the support surface along a horizontal substrate in the normal position of said support member said anvil is spaced away from the substrate, and said support member may be resiliently deflected by pressing the housing toward the substrate to bring the anvil into contact with tape being applied to that substrate.

8. A tape applicator according to claim 7 wherein said housing further includes a ramp member on each end of said cutting edge and projecting above said cutting edge to raise the portion of the tape being cut by said edge above the substrate while the tape is being severed by the cutting edge.

9. A tape applicator according to claim 7 wherein the retaining surface of said retainer is generally cylindrically convex about an axis disposed at about a right angle to the axis of said hub.

* * * * *

UNITED STATES PATENT AND TRADEMARK OFFICE

CERTIFICATE OF CORRECTION

PATENT NO. : 4,591,407

DATED : May 27, 1986

INVENTOR(S) : Bruce E. Samuelson

It is certified that error appears in the above-identified patent and that said Letters Patent is hereby corrected as shown below:

In the Abstract, line 6, 12, 18, change "dispenser" to --applicator--.

Col. 1, lines 20, 32, 41 and 55;

Col. 2, lines 31, 49 and 67;

Col. 4, lines 43, 51 and 61;

Col. 5, lines 7, 38, 50 and 60;

Col. 6, lines 6, 37, 47 and 57; and

Col. 7, line 4, change "dispenser" to --applicator--.

Signed and Sealed this

Thirteenth Day of September, 1988

*Attest:*

DONALD J. QUIGG

*Attesting Officer*

*Commissioner of Patents and Trademarks*